United States Patent [19]

Sugiura et al.

[11] 4,031,020

[45] June 21, 1977

[54] CENTRAL SYSTEM FLUID COMPOSITION

[75] Inventors: Kensuke Sugiura, Kawasaki; Mineo Kagaya, Yokohama; Tokuo Fujisou, Kawasaki; Hiroyuki Aoki, Urawa; Takeichiro Takehara; Shigenori Kurata, both of Yokohama, all of Japan

[73] Assignees: Nippon Oil Company, Ltd., Tokyo; Nissan Motor Co., Ltd., both of Japan

[22] Filed: May 29, 1975

[21] Appl. No.: 582,404

[30] Foreign Application Priority Data

May 31, 1974 Japan ..... 49-60898

[52] U.S. Cl. ..... 252/56 R; 252/59; 252/73; 252/79

[51] Int. Cl.[2] ..... C10M 1/24

[58] Field of Search ..... 252/56 R, 59, 73, 75, 252/79

[56] References Cited

UNITED STATES PATENTS

| | | | |
|---|---|---|---|
| 2,408,983 | 10/1946 | Kollen | 252/56 R X |
| 2,500,203 | 3/1950 | Reiff et al. | 252/59 X |
| 2,616,854 | 11/1952 | Fenske | 252/56 R X |
| 2,980,744 | 4/1961 | Voltz | 252/59 X |
| 2,996,455 | 8/1961 | Brown et al. | 252/56 R |
| 3,168,588 | 2/1965 | White et al. | 252/59 X |
| 3,329,613 | 4/1967 | Fischer et al. | 252/59 |
| 3,340,193 | 9/1967 | Fields et al. | 252/56 R |
| 3,549,533 | 12/1970 | Tabor et al. | 252/56 R X |
| 3,595,796 | 7/1971 | Duling et al. | 252/73 |
| 3,608,385 | 9/1971 | Duling et al. | 252/73 X |
| 3,682,823 | 8/1972 | Smith et al. | 252/59 |
| 3,816,346 | 6/1974 | Coppock et al. | 252/56 R X |
| 3,842,134 | 10/1974 | Pratt | 252/59 X |
| 3,843,532 | 10/1974 | Duling et al. | 252/73 X |
| 3,852,204 | 12/1974 | Souillard et al. | 252/59 X |
| 3,981,813 | 9/1976 | Denherder et al. | 252/73 X |

*Primary Examiner*—Delbert E. Gantz
*Assistant Examiner*—Andrew H. Metz

[57] ABSTRACT

A central system fluid composition composed of 5–30% by weight of a viscosity index improver, up to 10% by weight of another additive, and the balance being a hydrocarbon-type base oil, which is characterized in that the hydrocarbon-type base oil is composed of 50–100% by weight, based on its total weight, of at least one chief base oil component selected from the group consisting of A. polybutenes with an average molecular weight of 100 – 500, B. homo- or copolymers with an average molecular weight of 100 to 500 of at least one $\alpha$-olefin containing 2–12 carbons, excepting butenes, and C. hydrogenation products boiling at 250°–380° C of high aromatic components which are obtained by cracking petroleum oils, and 0–50% by weight, based on its total weight, of a mineral oil; and that the viscosity index improver is composed of at least one component selected from the group consisting of 1. polymethacrylates with an average molecular weight of 50,000–200,000, which are obtained by polymerizing at least one ester of a saturated, monohydric aliphatic alcohol of 1–18 carbons with methacrylic acid, and
2. polymers with an average molecular weight of 10,000–200,000 which are obtained by polymerizing at least one compound selected from the group consisting of the olefins of 2–5 carbons, diolefins of 2–5 carbons and aromatic vinyl compounds.

15 Claims, No Drawings

CENTRAL SYSTEM FLUID COMPOSITION

This invention relates to a central system fluid composition. More particularly, the invention relates to a central system fluid composition which exhibits excellent physical and chemical properties such as the high flash point, high boiling point, good fluidity at low temperatures, high shear stability and high viscosity index.

In order to meet the strong demand of the industry to apply central hydraulic systems to vehicles, the specifications of SAE 71R1 were recently established in U.S.A. The advantages to use central hydraulic systems in vehicles are as follows. The application enables the operation of versatile parts and member through a single hydraulic source using a single type fluid, and accordingly dispenses with the individual hydraulic systems for actuating brakes, power steering, wipers, air-conditions, starting motors, clutches and hydropneumatic suspensions. Thus the size of the hydraulic system to be accommodated in a vehicle can be reduced, and separate devices for cleaning exhaust gases or improving safety can be sufficiently and easily installed. Furthermore, still additional advantages such as the reduction of oil leakage troubles, easier maintenance, and utilization of electronic circuits for the hydraulic system, can be obtained.

The SAE 71R1 specification set forth under the above-described circumstances are prepared based on the characteristics required for the fluids used in power steering and brake systems. The properties required in the specifications are as follows:

1. Good fluidity at low temperatures,
2. High shear stability,
3. Operability over a wide temperature range,
4. High boiling point and flash point,
5. Freedom from the formation of precipitates and/or condensates at low temperatures,
6. Little foaming,
7. High lubricating property and oxidation resistance, and
8. Freedom from causing corrosion of metal portions of the hydraulic system and excessive swelling or shrinkage of rubber parts.

Because the requirements are rigorous and versatile, none of the presently commercially available central system fluids can yet pass all the tests regulated in SAE 71R1 specifications, although some of them do partly reach the required levels.

An object of the present invention is to provide a novel central system fluid composition which meets all requisites of SAE 71R1 specifications. This object can be accomplished by the fluid composition of the invention specified below.

The invention provides a central system fluid composition composed of 5–30 wt% of a viscosity index improver, up to 10 wt% of another additive, and the balance being a hydrocarbon-type base oil, which is characterized in that the hydrocarbon-type base oil is composed of 50–100 wt%, based on the total weight of said base oil, of at least one chief base oil component selected from the group consisting of;

A. polybutenes of 100–500 in average molecular weight,

B. homo- or copolymers with an average molecular weight of 100to 500 of at least one $\alpha$-olefin containing 2–12 carbons, excepting butenes, and C. hydrogenation products boiling at 250°–380° C of high aromatic components which are obtained by cracking petroleum oils, and 0 to 50 wt%, based on the weight of the hydrocarbon-type base oil, of a mineral oil; and that the viscosity index improver is composed of at least one component selected from the group consisting of 1. polymethacrylates of 50,000–200,000 in average molecular weight, which are obtained by polymerizing at least one ester of a saturated, monohydric aliphatic alcohol of 1–18 carbons with methacrylic acid, and 2. polymers of 10,000–200,000 in average molecular weight, which are obtained by polymerizing at least one compound selected from the group consisting of the olefins of 2–5 carbons, diolefins of 2–5 carbons and aromatic vinyl compounds.

The hydraulic fluid composition of the invention is the first and only product which fully satisfies the extremely rigorous SAE 71R1 specifications, acid is particularly suited for the central systems of vehicles. The composition of the invention is composed of the hydrocarbon-type base oil and the additives.

Hereinafter the composition of the invention will be more specifically explained.

1. Hydrocarbon-type base oil

The hydrocarbon-type base oil is that composed chiefly of at least one member of the group consisting of especific polybutenes, poly-$\alpha$-olefins and hydrogenation products of high aromatic components obtained by cracking petroleum oils, such as those later described in detail. The base oil contains, based on the total weight of the base oil, 50–100 wt.%, preferably 80–100 wt.%, of the above-specified compound or a mixture of the compounds. Of the named compounds, polybutenes are the most preferred. When the base oil is a mixture of the polybutenes, the poly-$\alpha$-olefins, and the hydrogenation products of high aromatic components obtained by petroleum cracking, it is recommended to select the blend ratio to make the viscosity of the mixture not higher than 6.0 cSt at 100° F (37.8° C), and not higher than 2.0 cSt at 210° F. (9.89° C). If so desired, it is permissible according to the invention to cause the base oil to contain up to 50% by weight of a mineral oil. Preferred mineral oils are those having a viscosity of not more than 6.0 cSt at 100° F., and not more than 2.0 cSt at 210° F., a viscosity index of not lower than 70, and a pour point of not higher than −30° C. The base oil may furthermore contain, besides the foregoing, up to 50% by weight, based on that of the hydrocarbon-type base oil, of nuclear hydrogenation product of heavy alkylbenzene and the like.

The hydraulic fluid composition of the invention, in which the specified hydrocarbon-type base oil is employed, shows characteristically excellent fluidity at low temperatures. Also with the fluid composition the additives, particularly the viscosity index improver, can exhibit conspicuous effects.

1-1 Polybutenes

The adequate polybutenes to be employed as the hydrocarbon-type base oil according to the invention are commercially available polybutenes of average molecular weight ranging from 100 to 500, preferably 150 to 300. Those having an average molecular weight of less than 100 possess inadequately low flash points, while those having a molecular weights greater than 500 have too high viscosities, and both fail to achieve the object of this invention. On the other hand, suitable viscosities are not higher than 6.0 cSt at 100° F., and not higher than 2.0 cSt at 210° F., and so far as the viscosity is kept within that range, minor amounts of heavier polybutene or hydrogenated polybutene may be used concurrently. The method of their preparation is well known to the experts. For example, a butane-butene fraction of the distillate collected in the procedure of naphtha cracking is used as a starting material, which is polymerized at −30° C to 30° C. in the presence of so-called Friedel-Crafts catalyst such as aluminium chloride, magnesium chloride, boron fluoride, or titanium tetrachloride, or complexes thereof, end if necessary also in the presence of a promotor such as an organic halide or hydrochloric acid.

1-2 Poly-α-olefins

The poly-α-olefins useful as the hydrocarbon-type base oil can be suitably formed by homo- or co-polymerization of at least one olefin of 2 to 12 carbons (excepting butene), particularly of 6–9 carbons. Of such poly-α-olefins, those having a viscosity of not higher than 6.0 cSt at 100° F. and not higher than 2.0 cSt at 210° F. are suitably used. For this reason, the poly-α-olefins of 100–500, preferably 150–300, in average molecular weight are employed. Those of average molecular weights less than 100 have objectionably low flash points. Those of the average molecular weights greater than 500 show undesirably high viscosities. Any of the known methods for the preparation of poly-α-olefins may be employed, so far as the product meets the above requirements, for example, cationic polymerization in the presence of such catalyst as aluminum chloride-aluminium bromide system, aluminium bromide-hydrogen bromids system, boron fluoride-alcohol system, aluminium chloride-ester system, and the like; radical polymerization using heat or peroxide or the polymerization assisted by Ziegler-type catalyst.

1–3 Hydrogenation products of high aromatic components obtained by cracking petroleum oils The hydrogenation products of high aromatic components obtained by cracking petroleum oils (naphtha, for example) useful for the present invention are those having a boiling point ranging from 250° to 380° C. Such hydrogenation products can be obtained by, for example, first subjecting the high aromatic component to hydrofining, and further hydrogenating the same to cause the nuclear hydrogenation of the greatest part of the aromatic hydrocarbons. The hydrofining is performed under the catalytic action of a transition metal such as nickel, cobalt or molybdenum, or oxide or sulfide of the foregoing, as supported on a suitable carrier such as alumina, or silica-alumina, usually yet temperatures ranging from 250° to 400° C., pressures ranging from 20 to 50 Kg/cm$^2$G, with a hydrogen/oil molar ratio of 2 to 10, and LHSV of 1 to 5. Also the hydrogenation is performed using a similar catalyst to those named as to the prior hydrofining, normally at 100° to 300° C., atmospheric to 300 Kg/cm$^2$g, with a hydrogen/oil molar ratio of 5 to 20, and LHSV of 0.5 to 2.0. Such hydrogenation products having a boiling point lower than 250° C. have objectionably low flash points. But, those having the boiling point higher than 380° C. have an undesirably high viscosity. As the hydrocarbon-type base oil composed chiefly of the naphthene-type hydrocarbons, those having a specific gravity of $d_4^{20}$ 0.850–0.950, a refractive index of 1450–1520, a viscosity of not higher than 6.0 cSt at 100° F., and not higher than 2.0 cSt at 210° F., and a pour point not higher than −45° C. are preferably used.

2. Additives

The hydraulic fluid composition of the invention is prepared by mixing the above-described hydrocarbon-type base oil with a specific viscosity index improver as the additive, and if necessary also with other additive or additives suitably selected, such as an antioxidant, detergent, metal deactivator, antifoaming agent or rubber swelling agent. We found that in order to achieve the object of this invention to provide the contral system fluid satisfying SAE 71R1 specification, the selection of adequate viscosity index improver is most important. Specifically, the viscosity index improver to be employed in this invention should possess high shear stability, high viscosity-increasing effect but at such low temperature as −40° C., low viscosity-increasing effect. As such viscosity index improver useful for the invention, at least one member of the group consisting of 1. polymethacrylates with an average molecular weight ranging from 50,000 to 200,000, which are obtained by polymerizing at least one ester of a saturated, monohydric straight-chain or branched-chain aliphatic alcohol of 1–18 carbons with methacrylic acid, 2. polymers with an average molecular weight ranging from 10,000 to 200,000, preferably 40,000 to 100,000, which are obtained by polymerizing at least one compounds selected from the group consisting of olefins of 2 to 5 carbons, diolefins of 2 to 5 carbons, and aromatic vinyl compounds such as styrene (for example, ethylene-propylene copolymer, isobutylene homopolymer, butadiene-styrene copolymer, isoprene-styrene copolymer and the like) may be used.

While it is permissible to use mixtures of the above components (1) and (2) in optional blend ratios as the viscosity index improver according to the present invention, the component (1) is the more preferred. The viscosity index improver in this invention is suitably used in a proportion of 5–30 wt.%, preferably 10–20 wt.%, based on the total weight of the composition.

According to the invention, various additives used in the art, other then the viscosity index improver, may be used if necessary. The weight percents indicated for each type of additives hereinbelow are all based on the total weight of the composition.

As the antioxidant, for example, metal salts of dialkyldithiophosphoric acids, phenyl-α-naphthylamine, 2,6-di-t-butyl-p-cresol, 2,6-di-t-butylphenol and the like are preferred, which may be used singly or as mixtures. The suitable amount of the antioxidant ranges from 0.1 to 3.0 wt.%.

As the detergent, for example metal-containing compounds such as neutral metal sulfonates basic metal sulfonates, superbasic metal sulfonates, metal phenates and metal phosphonates and ashless dispersants such as alkenyl succinimides and benzylamines may be named. They can be used singly or as mixtures in an amount of 0 to 4.0 wt.%.

Besides the foregoing, a metal deactivator such as benzotriazole may be added in an amount within the range of 0.005–0.5 wt.%, and an antifoaming agent such as silicone or ester-type antifoaming agents, for example, a low molecular weight polymethacrylate, may be added in an amount of up to 0.5%. Furthermore, when polybutene or polyα-olefin is used as the base oil, nitrile rubber undergoes shrinkage. In order to prevent it, an aromatic compounds as the rubber-swelling agent may be added, if necessary, in an amount of 1–3 et.%. The total sum of the above various additives excepting the viscosity index improver should be 0.1–10 wt.%, and within said range optional ratios can be selected so far as no deleterious effect is produced on the viscosity characteristics and fluidity at low temperatures.

As already mentioned, the composition of the present invention is the first and only hydraulic fluid composition satisfying all the requirements of SAE 71R1 specifications. The composition is particularly suited for use as central system fluid, but also have other uses such as brake fluid, shock-absorbing fluid and automatic transmission fluid.

Hereinafter the invention will be more specifically illustrated with reference to working examples, it being understood that the hydraulic fluid composition of this invention is by no means limited thereby.

EXAMPLE 1

| Composition | Percent by Weight |
|---|---|
| Note 1) Polybutene A | 78.0 |
| Note 2) Viscosity index improver | 18.4 |
| Antioxidant (zinc di-2-ethyl-hexyldithiophosphate) | 0.9 |
| Detergent (calcium sulfonate and calcium phenate) | 2.1 |
| Metal deactivator (2,5-di-mercspto-1,3,4-thiadiazole) | 0.5 |
| Antifoaming agent (low molecular weight polymethacrylate) | 0.1 |

Note 1) "Polybutene A" has an average molecular weight of approximately 250, and a viscosity of 4.88 cSt (100° F.) and 1.59 cSt (210° F.)

Note 2) The polymethacrylate of average molecular weight of 143,000, which is obtained by polymerizing an ester of saturated monohydric aliphatic alcohol of 1–18 carbons containing not less than 60 wt.% of n-dodecyl alcohol with methacrylic acid.

EXAMPLE 2

| Composition | Percent By Weight |
|---|---|
| Note 1) Polybutene A | 75.8 |
| Note 2) Polybutene B | 4.0 |
| Note 3) Viscosity index improver | 16.6 |
| Antioxidant (same as that employed in Example 1) | 0.85 |
| Detergent (same as that employed in Example 1) | 2.2 |
| Metal deactivator (same as that employed in Example 1) | 0.5 |
| Antifoaming agent (same as that employed in Example 1) | 0.05 |

Note 1) The details are the same as those of Example 1.

Note 2) "Polybutene B" has an average molecular weight of approximately 310, and a viscosity 21 cSt (100° F.) and 4.0 cSt (210° F.). The mixture of polybutene A and polybutene B has a viscosity of 5.21 cSt (100° F.).

Note 3) A mixture of 20 parts of the polymethacrylate employed in Example 1 and 80 parts of an ethylene/propylene copolymer of average molecular weight of 50,000.

EXAMPLE 3

| Composition | Percent By Weight |
|---|---|
| Note 1) Polybutene A | 53.7 |
| Note 2) Mineral oil | 28.9 |
| Note 3) Viscosity index improver | 14.1 |
| Antioxidant(2,6-di-t-butyl-p-cresol) | 0.95 |
| Detergent(alkyl succinimide | 2.2 |
| Metal deactivator (2,5-di-mercapto-1,3,4-thiadiazole) | 0.1 |
| Antifoaming agent (low molecular weight polymethacrylate) | 0.05 |

Note 1) The details are the same as those of Example 1.

Note 2) A paraffinic hydrocarbon oil which has been dewaxed at low temperature −40° C.

Note 3) The same polymethacrylate as employed in Example 1.

EXAMPLE 4

| Composition | Percent By Weight |
|---|---|
| Note 1) Poly-α-olefin | 80.8 |
| Note 2) Viscosity index improver | 16.0 |
| Antioxidant (the same as that used in Example 3) | 0.7 |
| Detergent (the same as that used in Example 3) | 2.2 |
| Metal deactivator (the same as that used in Example 3) | 0.28 |
| Antifoaming agent (the same as that used in Example 3) | 0.02 |

Note 1) The b.p. 65–250° C./0.4 mmHg fraction of the distillate from the product of octane-1 polymerization at atmospheric pressure and 30° C., in the presence of a normal ziegler-type catalyst, having a molecular weight of 320 and the viscosity of 1.95 cSt (210° F.)

Note 2) The same polymethacrylate as used in Example 1.

EXAMPLE 5

| Composition | Percent By Weight |
|---|---|
| Note 1) Hydrogenation product of high aromatic components | 82.0 |
| Viscosity index improver | 15.0 |
| Antioxidant (the same as that used in Example 1) | 0.7 |
| Detergent (the same as that used in Example 1) | 2.2 |
| Metal deactivator (the same as that used in Example 1) | 0.1 |
| Antifoaming agent (silicone-type) | 20 ppm |

Note 1) The b.p. 210 – 370° C. fraction of distillate from the heavy oil obtained by thermal cracking of naphtha, is hydrofined and further hydrogenated. By destillation, a fraction boiling at 265° – 307° C. is collected. The reaction conditions and the properties of the hydrogenation product are as follows:

EXAMPLE 5-continued

| | Hydrofining | Hydrogenation |
|---|---|---|
| Catalyst | nickel-molybdenum-alumina | nickel-diatomaceous earth promoted by chromium and copper (nickel content, 45%) |
| Reaction Pressure (Kg/cm²) | 35 | 70 |
| Reaction Temp. (°C.) | 330 | 200 |
| Hydrogen/Oil molar ratio | 3.5 | 16 |
| LHSV | 3 | 1.0 |

EXAMPLE 5-continued

| | |
|---|---|
| Specific gravity $d_4^{20}$ | 0.9349 |
| Refractive index $n_D^{20}$ | 1.5056 |
| Average molecular weight | 200 |
| Viscosity cSt (100° F.) | 5.150 |

Note 2) The same polymethacrylate as used in Example 1.

Table 1 shows the results obtained by subjecting the composition of Example 1 to the standard tests of central system fluid based on SAE 71R1 specifications. The composition passed all the tests.

Similarly the compositions of Examples 2 to 5 were tested and passed all the items with satisfactory results.

Table 1

| No. | Test Items | Test Method | SAE 71R1 Specifications | Test Results | Judgment |
|---|---|---|---|---|---|
| 1 | Viscosity-Kinematic | Based on the SAE 71 R1 specifications | 2000 cSt max. at −40° F. (before and after shear) as determined by Low Temperature (−40° F.) Viscosity-Brook-filed Procedure | 1860 cSt | passed |
| | | | 5.5 cSt min. at 210° F (after shear) as determined by the procedure outlined by ASTM D 445. | before shear 7.75 cSt<br>after shear 6.52 cSt | |
| 2 | Flash Point | " | 225° F. (107.2° C.) min. as determined by the ASTM D 92 method | 118° C. | passed |
| 3 | Initial Boiling Point | " | 400° F. (204° C.) min. as determined by the ASTM D 158 method | 226° C | passed |
| 4 | Cold Test | " | The sample should be transparent and show no stratification or sedimentation after 6 days' standing at −50° F. in accordance with SAE J 70R3 method | Satisfactory | passed |
| 5 | Fluidity and Appearance at Low Temperature (Brake Fluid) | after 6 days standing at -−40° C., the air bubble shall rise to the top of the fluid in not more than 10 sec. upon inversion of the sample bottle according to SAE 70R3 method | — | 1 sec. | passed |
| | | After 6 hours' standing at −50° C. the air bubbles shall have the rise velocity of no more than 35 sec. | | 5.4 sec. | passed |
| 6 | Foaming | Based on SAE 71 R1 specifications | i) 100 ml foam valume max. at end of 5-minute blowing period | 85 ml | |
| | | | ii) No foam left at end of 4-minute settling period; as determined by ASTM D 892 method | No foam after the settling | passed |
| 7 | Corrosion Resistance | Based on SAE 71 R1 specifications | As determined by ASTM D 665 turbine oil test with distilled water | no rust | passed |
| 8 | Seal comp- | Based on SAE | Based on SAE 70 R3, | | |

Table 1-continued

| | | | | | |
|---|---|---|---|---|---|
| | atibility (Rubber Swelling) | 71 R1 specifications | the increase in the base diameter of nitrile rubber cups after 70 hours' immersion in sample liquid at 250± 50° F. shall not be less than 0.125 mm, nor more than 1.375 mm The rubber surface shall not be tucky or show any sloughing as may be indicated by carbon black on the surface. | 0.755 – 1.371 mm<br>Satisfactory | passed |
| 9 | Shear Test* | | | | |
| | (a) Power steering Pump Test | 5.5 cSt min. after 100 operation of pump. at 65.5° C. pump entrance temperature. See SAE Recommended Practice, SAE J72 | | 6.52 cSt (210° F.) | passed |
| | (b) High-pressure Vane Pump Test (of hydraulic oils | Based on ASTM D-2882-70T | | Operation time after breaking in (hrs.) / Viscosity (cSt, 98.9° C.)<br>0 / 7.87<br>20 / 7.58<br>66 / 7.30<br>100 / 7.02 | passed |
| | (c) Sonic Shear Stability (of polymer-containing oils) | Based on ASTM D-2603 | — | Viscosity at end of 4 hours' irradiation 6.15 cSt (210° F.)<br>Viscosity reduction ratio 20.7% | passed |
| 10 | Anti-wear | Based on SAE 71 R1 Specifications | Pump delivery at 700 rpm and 600 psi discharge shall not decrease more than 0.2 gpm during 100 hrs. as indicated by measurements on Standard Reference Fluid at start and end of test as determined by Wear and Pump Delivery Test<br>Pump parts, by visual inspection, shall show no signs of excessive wear. Parts should be burnished and show no signs of galling. | Pump discharge normal, no wear observed | passed |
| 11 | Shell high speed fourball test 1800 rpm 1 hr. | | — | The sample had equivalent wear characteristics with commercial hydraulic oil as below<br>Load (kg) / Central System fluid of Example 1 / Commercial hydraulic fluid A / B<br>30 / 0.45 / 0.40 / 0.36 0.39<br>40 / 0.55 / 0.69 / 0.45 0.51<br>50 / 0.83 / 0.72 / 0.76 0.95<br>Unit; wear marks mm | passed |
| 12 | Oxidation Stability | Total rating 80 min. evaluation of cleanness at end of 300 hrs. measurements at 275° F. using an automatic transmission, based on SAEJ72. | — | 1. Property Change of Sample Oil<br>Time(hr) / 0 / 100 / 200 / 300<br>Viscosity cSt(100° F) / 25.40 / 25.21 / 25.54 / 25.54<br>Viscosity cSt (210° F) / 7.74 / 7.57 / 7.57 / 7.43<br>Acid value (mg KOH/g) / 1.42 / 1.16 / 1.29 / 1.48<br>Base value (wt.%) / 2.66 / 1.13 / 0.98 / 0.77<br>Insolubles in petroleum ether / 0.01 / 0.14 / 0.17 | |

Table 1-continued

| | | | | |
|---|---|---|---|---|
| (wt.%) Insolubles in benzene (wt.%) | | 0 | 0.08 | 0.11 |
| 2. Cleanness Evaluation (10 at best) | | | | |
| | | Varnish*1 | Sludge*2 | |
| Turbine outer surface | | 10 | — | |
| Converter housing outer) | | — | 10 | |
| Screen | | 10 | 10 | passed |
| Steel clutch plates | | 10 | — | |
| Valve body (outer) | | 10 | — | |
| Valve body (cavities) | | — | 10 | |
| Clutch piston | | — | 10 | |
| Clutch cylinder | | — | 9.9 | |
| Bottom of transmission | | 10 | — | |
| | Total | 50 | 49.9 | |

*1Based on CRC Manual No. 9.
*2Based on CRC Manual No. 10.
3. As above-indicated, substantially no viscosity change was observed with time passage: The infrared absorption spectrum of the fluid at end of 300 hours' use neither should any absorption of oxidation product caused from deterioration. The cleanness evaluation was as high as 99.9.
*Concerning the ninth test item, "Shear Test," the test apparatus designated by SAE 71R1 specifications were unavailable. Accordingly, the judgments were made by substituting the equivalent test methods (a), (b) and (c) for the specified methods.

We claim:

1. A central system fluid composition consiting essentially of 5–30% by weight of a viscosity index improver and the balance being essentially a hydrocarbon base oil, which is characterized in that the hydrocarbon base oil is composed of 50–100% by weight, based on its total weight, of at least one chief base oil component selected from the group consisting of A. polybutenes with an average molecular weight of 100–500, B. homo- or copolymers of at least one $\alpha$-olefin containing 2–12 carbons, excepting butenes, said homo- or copolymer having a molecular weight of 100 to 500 and wherein the copolymers are obtained by copolymerizing a mixture of said $\alpha$-olefins with each other; and C. hydrogenation products boiling at 250°–380° C of high aromatic hydrocarbons which are obtained by cracking petroleum oils, and 0–50% by weight, based on its total weight, of a mineral oil, and wherein the viscosity index improver is composed of at least one component selected from the group consisting of 1. polymethacrylates with an average molecular weight of 50,000–200,000, which are obtained by polymerizing at least one ester of a saturated, monohydric aliphatic alcohol of 1–18 carbons with methacrylic acid, and 2. copolymers with an average molecular weight of 40,000–200,000 selected from the group consisting of ethylene-propylene copolymers, butadiene-styrene copolymers and isoprene-styrene copolymers.

2. The composition of claim 1, in which the content of the chief base oil component in the total hydrocarbon base oil is 80–100% by weight.

3. The composition of claim 1, in which the polybutenes, the poly-$\alpha$-olefins and the hydrogenation products of high aromatic hydrocarbons all possess a viscosity of not more than 6.0 cSt at 100° F., and not more than 2.0 cSt at 210° F.

4. The composition of claim 1, in which the hydrocarbon base oil is a polybutene with an average molecular weight of 100 to 500.

5. The composition of claim 4, in which the polybutene has an average molecular weight of 150 to 300.

6. The composition of claim 1, in which the mineral oil has a viscosity of not more than 6.0 cSt at 100° F. and not more than 2.0 cSt at 210° F., a viscosity index of at least 70, and a pour point of not higher than −30° C.

7. The composition of claim 1, in which the viscosity index improver content, based on the total weight of the composition, ranges from 10 to 20% by weight.

8. The composition of claim 1, in which the viscosity index improver is a polymethacrylate with an average molecular weight of 50,000–200,000, which is obtained by polymerizing at least one ester of a saturated monohydric aliphatic alcohol of 1–18 carbons with methacrylic acid.

9. The composition of claim 1 wherein the viscosity index improver is a copolymer (2) with an average molecular weight of 40,000–100,000.

10. In an improved central system fluid composition comprising a major proportion of a base oil, a viscosity index improver and an effective amount up to 10% of at least one additive selected from the group consisting of detergents, antioxidants, metal deactivators and antifoaming agents, the improvement wherein the base oil and viscosity index improver comprises the composition of claim 1.

11. The composition of claim 10 wherein the total sum of the additives is 0.1 to 10 wt%, based on the weight of the composition.

12. A composition according to claim 10 wherein the additive is an antioxidant present in an amount of 0.1 to 3.0 wt%, based on the weight of the composition.

13. A composition according to claim 10 wherein the additive is a metal deactivator present in an amount of 0.005–0.5 wt%, based on the weight of the composition.

14. A composition according to claim 10 wherein the additive is a detergent present in an amount of 0–4.0 wt%, based on the weight of the composition.

15. A composition according to claim 10 wherein the additive is an antifoaming agent present in an effective amount to up 0.5 wt%, based on the weight of the composition.

* * * * *